US005893304A

United States Patent [19]

Carroll

[11] Patent Number: 5,893,304

[45] Date of Patent: Apr. 13, 1999

[54] ROOFING REMOVAL TOOL

[76] Inventor: James P. Carroll, 1110 Farmington Ave., West Hartford, Conn. 06107

[21] Appl. No.: 08/820,747

[22] Filed: Mar. 19, 1997

[51] Int. Cl.[6] .....

[52] U.S. Cl. ..... 81/45; 254/131.5; 30/169; 299/36.1

[58] Field of Search ..... 81/45; 254/131.5; 30/169, 170; 299/36.1

*Primary Examiner*—James G. Smith
*Attorney, Agent, or Firm*—Alix, Yale & Ristas, LLP

[57] ABSTRACT

A roofing removing tool has a shingle removing body for removing shingles from a roof deck. The shingle removing body has a plurality of elongated tines having a forward portion insertable beneath shingles to be removed. A handle extends rearwardly from the shingle removal body for manipulation of the tool. The tool further has a nail removal body for simultaneously removing nails from a roof deck as shingles are removed from the roof deck. The nail removing body has a nail removing blade supported in spaced relationship to and below the tines, and is positioned rearwardly of the forward portion of the tines and adjacent the handle.

14 Claims, 3 Drawing Sheets

ROOFING REMOVAL TOOL

FIELD OF THE INVENTION

The present invention relates generally to the field of roofing. More particularly, it is directed to a new and improved tool for stripping roofing materials from a roof deck.

BACKGROUND OF THE INVENTION

Frequently it is necessary to strip old roofing materials from a roof deck before the application of new roofing materials. The old roofing materials requiring removal are typically roofing shingles and roofing nails although other materials, such as tar paper and the like, also may be stripped during removal of the old roof. Roofers often employ a shovel or other tool to remove or strip these materials from a roof. The shovel or other tool is inserted under the lip of the exposed shingles and the shingle is lifted away from the roof deck. The roofing nails employed to hold down the shingles generally tear through the shingles during the lifting process and remain imbedded in the underlying roof structure. After the shingles have been stripped, the remaining individual roofing nails protrude from the deck and must be either withdrawn from the deck or driven down into the deck to allow for the application of the new roofing materials. The requirement to withdraw the old roofing nails, or to drive them into the roof deck increases the total required time for removal of the old roofing and installation of the new roofing, thereby increasing the total cost of the roofing operation.

SUMMARY OF THE INVENTION

Briefly stated, the present invention is a roofing removal tool for the rapid and efficient removal of roofing materials, including roofing shingles and roofing nails, from an underlying roof deck in a single operation. The roofing removal tool in accordance to the invention has a shingle removal body for lifting the shingles. The shingle removal body has a plurality of spaced apart, parallel, elongated tines. The plurality of tines are connected by a cross piece at one end, and each tine terminates in a tine tip at the opposite end. The tines further have an upper surface, a lower surface, a forward portion positioned closer to the tine tip and a rearward portion positioned closer to the cross piece.

The roofing removal tool further has an associated nail removal body for the removal of nails from a roof deck. The nail removal body has a nail removal blade supported below the tines adjacent the cross piece for the tines. The nail removal blade preferably defines a plurality of teeth oriented generally in line with the tines. The teeth of the nail removal blade define notches therebetween for receiving the shanks of nails imbedded in a roof deck. A handle extends from the cross piece of the shingle removal body for grasping by a roofer.

In use, the tines of the roofing removal tool are inserted under a lip of an exposed layer of shingles to be removed and is driven forwardly under the shingle. The roofing tool handle is lifted to pivot on the forward portions of the tines or on the tine tips. The pivoting of the roofing removal tool lifts the shingles upward and thereby tears and strips the shingles from the roof deck. Preferably the continued forward movement of the tool permits the teeth of the nail removal blade to engage the shanks of roofing nails extending from the roof deck. The roofing removal tool is then again pivoting on the forward portions of the tines or tine tips or on the nail removal blade to pry the roofing nails from the roof deck.

In a further embodiment of the roofing removal tool in accordance with the invention, the forward portions of the tines together define a first plane. The rearward portions of the tines together define a second plane oriented generally obtuse to the first plane. The nail removal blade is generally planar and preferably oriented parallel with the first plane of the forward portions of the tines. The parallel planar relationship of the nail removal blade and the first portions of the tines allows for smooth and efficient operation of the roofing removal tool for rapid shingle and nail removal by a roofer.

An object of the invention is to provide a roofing removal tool for the efficient removal of shingles and nails from a roof deck.

A further object of the invention is to provide a roofing removal tool that allows rapid removal of both shingles and roofing nails from the roof deck in generally the same operation.

These and other objects of the invention will become apparent from review of the specification and drawings.

DETAILED DESCRIPTION OF THE PREFERRED EMBODIMENT

Figure 1:
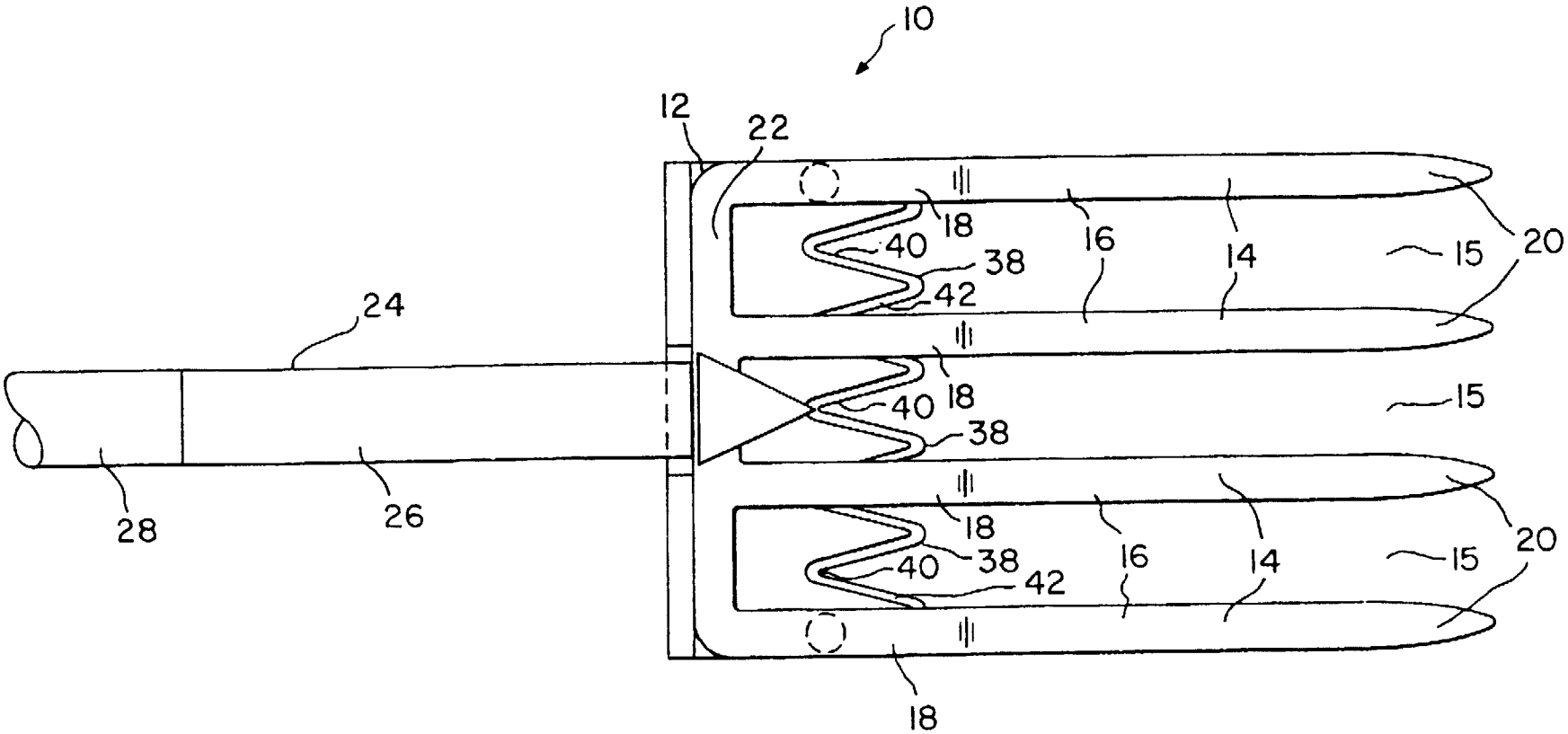
FIG. 1 is a top plan view, partially in phantom, of the roofing removal tool in accordance with the present invention.

Referring now to the drawings in greater detail wherein like reference numerals represent like components throughout the figures, the roofing removal tool 10 comprises a shingle removal body portion and a nail removal body portion 34 mounted thereto. The shingle removal body 12 has a plurality of spaced apart, generally parallel elongated tines 14. Each tine 14 has a forward portion 16 terminating in a free tine tip 20 and an integral rearward portion 18 connected to each other by a cross face 22. Each tine 14 further defines an upper surface 30 and a slightly tapered lower surface 32. The tines 14 are uniformly spaced to define openings 15 therebetween that are significantly wider than the width defined by a single tine 14. The tines 14 are preferably triangular in cross section whereby the upper surface 30 of each tine 14 is flat to permit smooth sliding action of the shingles therealong as the roofing removal tool 10 is employed for roofing removal. The cross piece 22 is oriented generally perpendicular to the direction of the tines 14 to integrally interconnect the rearward portions 18 of each of the tines 14. A handle 24 extends from the cross piece 22, generally in line with the tines 14. The handle 24 has a handle socket 26, preferably welded or otherwise fixedly connected to the cross piece 22 and a shaft 28 for grasping and manipulating by the hands of a roofer.

Figure 2:
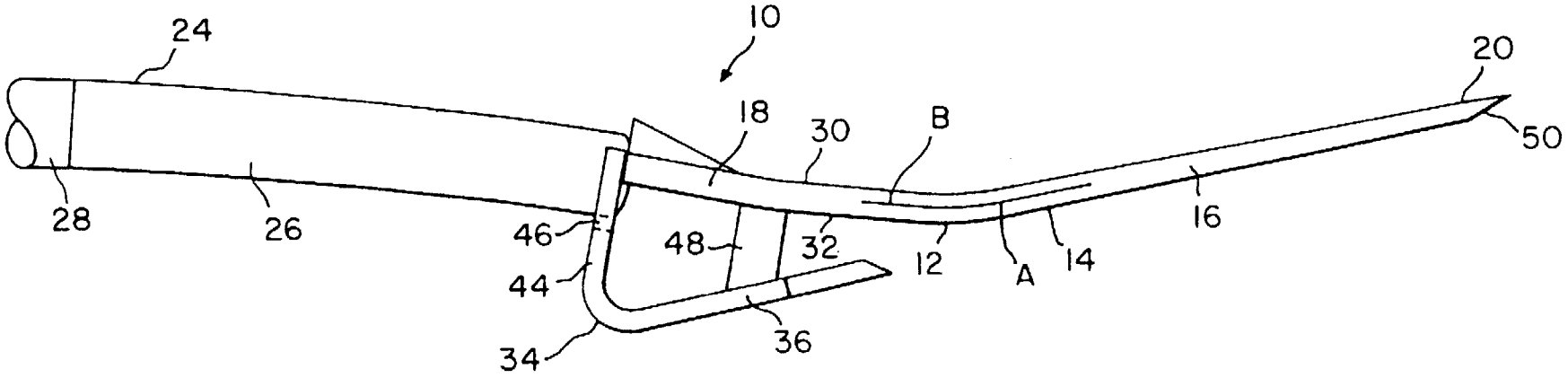
FIG. 2 is a side elevational view of the roofing removal tool of FIG. 1.
Figure 3:
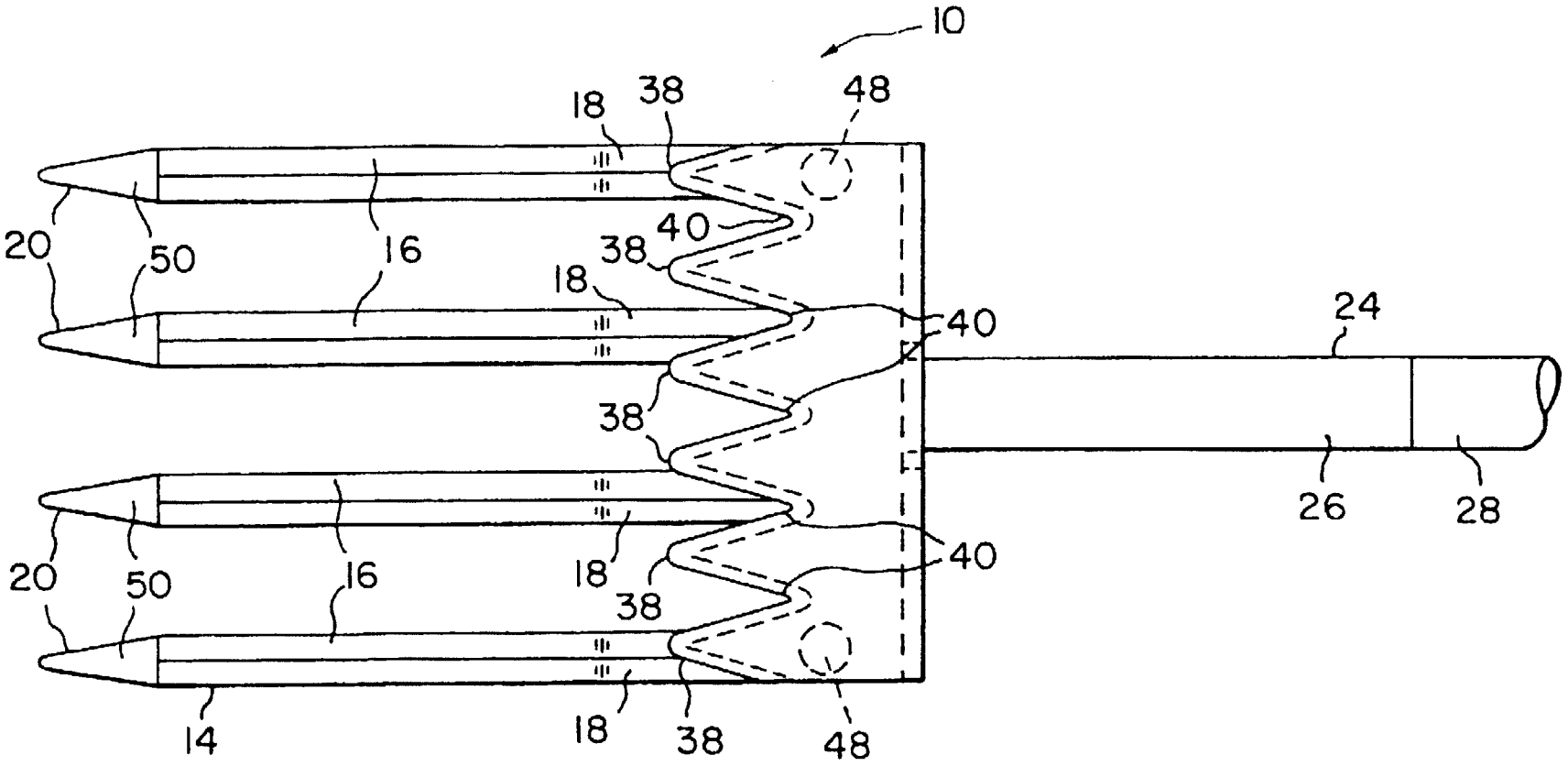
FIG. 3 is a bottom plan view, partially in phantom, of the roofing removal tool of FIG. 1.

As best seen in FIG. 2, the forward portions 16 of the tines 14 together define a first plane A, while the rearward portions 18 together define a second plane B oriented generally at an obtuse angle to the first plane A. The bend of the tines provide a gradual interconnection between planes A and B with the bend being at the same position along the length of each tine 14.

The nail removal body portion 34 is positioned adjacent but spaced from the lower surfaces 32 of the tines 14. It includes a generally planar nail removal blade portion 36 positioned below the rearward portions 18 of the tines 14, and spaced apart from the lower surface 32. The nail removal blade 36 defines a plurality of teeth 38 defining notches 40 therebetween. The teeth 38 are oriented generally in line with and face in the same direction as the tines 14. The tips of the teeth 38 are slightly rounded to reduce the possibility of penetration of the nail removal blade 36 into the surface of a roof deck and to permit slight lateral shift upon contact with any nails. The notches 40 of the nail removal blade 36 also are preferably slightly radiused to define a U-shaped opening for improved grasping of the shank of a roofing nail extending from a roof deck. The nail removal blade 36 is further provided with a bevel 42 along the leading edge of the teeth 38 and notches 40. As best seen in FIG. 1, the bevel 42 is oriented toward the lower surface 32 of the tines 14 and is preferably at an angle of about 45° to allow the nail removal blade 36 to sufficiently grasp the undersides of the heads of the roofing nails.

The nail removal body portion 32 further has a support portion 44 extending between the nail removal blade 36 and the shingle removal body 12. The nail removal blade 36 and the support portion 44 are preferably formed as a single integral member for improved strength. The support portion 44 extends for the full width of the nail removal blade 36 and supports the blade 36 along its full extent. The support portion 44 is fixed to the cross piece 22 by welding, brazing or other well known forms of fastening. A notch 46 is formed in the support portion 44 for accommodating the handle socket 26 at its area of attachment to the cross piece 22. In addition, support posts 48 extend between the lower surfaces 32 of the outermost tines 14 and the blade 36 to further support the nail removal blade 36 forwardly of the support 44 at approximately the lateral position of the blade where the notches 40 are located.

The nail removal blade 36 is generally planar and preferably oriented to be parallel to the first plane A of the forward portions 16 of the tines 14. The nail removal blade 36 is further preferably positioned below the first plane A of the forward portions 16, to reduce interference of the tines 14 with roofing nails when the nail removal blade 36 is employed to remove other roofing nails.

The tine tips 20 are provided with a shallow bevel 50 and the ends of the tip portions are slightly rounded. The bevels 50 are oriented toward the lower surface 32 of the tines 14 as shown in FIG. 2. The bevel 50 and the rounded tips reduce penetration of the roofing removal tool 10 into the underlying roof deck.

In use, the roofing removal tool 10 is slid along a roofing surface and the shingle removal body 12 is inserted underneath the shingles to be removed. The shallow bevel 50 and the rounded ends of the tine tips 20 allow the tines 14 to be inserted under the shingles to be removed without undue catching or penetration of the roofing removal tool 10 into the underlying roof deck. The roofing removal tool 10 is then slid forward to force the shingles to slide upward along the upper surface 30 of forward portions 16 of the tines 14. Further forward motion of the roofing removal tool 10 forces the shingles onto the more steeply sloped rearward portions 18 of the tines 14 thereby further pulling the shingles away from the roof deck. The shingles are therefore pulled away from the underlying roof deck and over the heads of a substantial number of the roofing nails that remain imbedded in the underlying roof deck. The roofing removal tool 10, if required to, may be further pivoted forward on the front portions 10 or tine tips 20 of the tines 14, or pivoted rearward on the nail removal body to further lift the shingles upward from the roof deck.

The large width of the openings 15 relative to the width of the tines 14 permits the shingle removal body 12 to rapidly and efficiently remove shingles without excessive catching of the roofing removal tool 10 on the roofing nails that remain embedded in the roof deck. In one roofing removal tool 10 constructed in accordance with the invention, it has been found that four tines 14 for a shingle removal body 12 having a width of 7.25 inches provide sufficient surface to remove shingles without undue interference from embedded roofing nails. An angled guide 52 can also be mounted to the cross piece 22 to guide the shingles further upward and prevent catching of the shingles on the handle socket 26 as the roofing removal tool 10 is moved forward.

As the roofing removal tool 10 is moved forward, the nail removal body 34 can be lowered into contact with the roofing deck wherein the blade 36 is generally parallel to, and in surface to surface contact with, the surface of the roofing deck. The roofing removal tool 10 is then moved forward until the nail removal blade 36 encounters roofing nails protruding from the roofing deck. The roofing nails are slid into the notches 40 defined by the teeth 38 as the roofing removal tool is moved forward. The radiused notches 40 then grasp the shanks and heads of the roofing nails. It has been found for a roofing removal tool 10 constructed in accordance with the invention, that a nail removal blade 36 having six teeth 38 defining five notches 40 for a blade width of 7.25 inches, the notches being approximately 1.25 inches apart, provides for an arrangement for efficient roofing nail removal. Furthermore, a radius of about one sixteenth inches for the notches 40 provides for improved engagement of the nail removal blade 36 with embedded roofing nails. The handle 28 of the tool is next pivoted upwardly on the forward portions 16 of the tines 14 or downwardly on the back portion of the nail removal blade 36 to withdraw the roofing nails from the roofing deck. The operation of the roofing removal tool 10 is continued until the roof has been cleared of all shingles and roofing nails.

While a preferred embodiment of the present invention has been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

What is claimed is:

1. A roofing removal tool comprising:

shingle removal means for removing roof shingles from a roof deck comprising a plurality of elongated tines each having a forward portion insertable beneath shingles to be removed;

handle means extending rearwardly from the shingle removal means for manipulation of the tool; and nail removal means for simultaneously removing nails from a roof deck as the shingles are removed comprising a nail engaging blade supported in spaced relationship to and below said tines, said blade being positioned rearwardly of the forward portion of the tines and adjacent the handle means.

2. The roofing removal tool of claim 1 wherein said blade comprises a plurality of teeth oriented in the same direction as the forward portion of the tines and defining nail engaging notches therebetween.

3. The roofing removal tool of claim 2 wherein the number of teeth in the blade exceed the number of tines.

4. The roofing removal tool of claim 1 wherein said forward portions define a first plane and said handle defines a second plane obtuse to said first plane.

5. The roofing removal tool of claim 1 wherein said forward portions define a first plane and said tines include a rearward portion defining a second plane obtuse to said first plane.

6. The roofing removal tool of claim 1 wherein said forward portions define a first plane, and said blade is planar and is supported within a plane generally parallel to said first plane.

7. The roofing removal tool of claim 1 wherein said tines have generally flat upper surfaces for guiding the shingles therealong.

8. The roofing removal tool of claim 1 wherein said shingle removal means further comprises a backing member fixedly supporting the tines, said handle means being fixed to said backing member.

9. The roofing removal tool of claim 1 wherein said nail removal means further includes a blade support extending between said blade and said shingle removing means for fixedly supporting said blade relative to said tines.

10. A roofing removal tool comprising:

a shingle removal body having a plurality of spaced apart and generally parallel elongated tines each having an upper surface and an opposite lower surface, a forward portion defining a first plane and a rearward portion defining a second plane obtuse to said first plane, and a cross member extending between and fixedly interconnecting said tines;

a handle fixed to said cross member; and a blade positioned below the lower surfaces of the second portions of said tines, said blade having a plurality of teeth defining nail engaging notches therebetween, and mounting means for mounting said blade to said shingle removal body.

11. The roofing removal tool of claim 10 wherein said tines have a preestablished tine width and define openings therebetween having a preestablished width greater than said tine width.

12. The roofing removal tool of claim 10 wherein the cross member extends between said tines at said rearward portion.

13. The roofing removal tool of claim 10 wherein said teeth are oriented generally parallel to said tines.

14. The roofing removal tool of claim 10 wherein said blade is substantially parallel with said first plane.

* * * * *